US005210694A

United States Patent [19]

Hayakawa

[11] Patent Number: 5,210,694

[45] Date of Patent: May 11, 1993

[54] EMBROIDERY DATA PROCESSING APPARATUS

[75] Inventor: Atsuya Hayakawa, Nagoya, Japan

[73] Assignee: Brother Kogyo Kabushiki Kaisha, Nagoya, Japan

[21] Appl. No.: 640,881

[22] Filed: Jan. 14, 1991

[30] Foreign Application Priority Data

Jan. 20, 1990 [JP] Japan ..... 2-11175

[51] Int. Cl.[5] ..... G06F 15/46; D05B 21/00

[52] U.S. Cl. ..... 364/470; 112/121.12

[58] Field of Search ..... 364/470; 112/103, 121.12, 112/266.1

[56] References Cited

U.S. PATENT DOCUMENTS 4,849,902 7/1989 Yokoe et al. ..... 364/470

4,964,352 10/1990 Yokoe et al. ..... 112/103

4,991,524 2/1991 Ozaki ..... 112/121.12

5,005,500 4/1991 Kato et al. ..... 112/121.12

*Primary Examiner*—Jerry Smith

*Assistant Examiner*—Steven R. Garland

*Attorney, Agent, or Firm*—Oliff & Berridge

[57] ABSTRACT

An apparatus for processing embroidery data used for filling an embroidery area with stitches, including a first device for selecting a division base point from a plurality of defining points predetermined on an outline of the embroidery area, based on outline data representative of the outline of the embroidery area, and a second device for selecting, based on the outline data, a division aid point from the defining points, so that the division aid point cooperates with the division base point to define a division line which divides the embroidery area into two subareas such that the outline of at least one of the two subareas satisfies a requirement predetermined with respect to smoothness at the division line.

9 Claims, 12 Drawing Sheets

FIG. 3

| RAM | 76 |
|---|---|
| OUTLINE DATA AREA | 76a |
| DIVIDED-OUTLINE DATA AREA | 76b |
| BEFORE-DIVISION STACK | 76c |
| AFTER-DIVISIOCN STACK | 76d |
| VERTEX STACK | 76e |
| FIRST CANDIDATE STACK | 76f |
| SECOND CANDIDATE STACK | 76g |
| THIRD CANDIDATE STACK | 76h |
| BLOCK DATA AREA | 76i |
| STITCH POSITION DATA AREA | 76j |

EMBROIDERY DATA PROCESSING APPARATUS

BACKGROUND OF THE INVENTION

1. Field Of The Invention

The present invention generally relates to an apparatus for processing embroidery data used for filling an embroidery area with stitches, and particularly to such an apparatus which divides an embroidery area into subareas and produces a set of embroidery data for filling each of the subareas with stitches.

2. Related Art Statement

The Applicant has proposed an embroidery data processing apparatus capable of automatically producing embroidery data. The processing apparatus includes (a) division base point determining means, (b) division aid point determining means, (c) embroidery area dividing means, and (d) embroidery data producing means.

The division base point determining means selects a division base point from a plurality of defining points predetermined on an outline of an embroidery area, based on outline data representative of the outline of the embroidery area. The division base point is utilized for defining a division line which divides the embroidery area into subareas.

An embroidery area to be filled with stitches may be a polygon, or a figure which is not a polygon but is approximated by a polygon. In these cases, the defining points predetermined on the outline of the embroidery area may be the vertices of the polygon. In addition, in the case where the outline of an embroidery area is approximated by a function such as a spline function, the defining points predetermined on the outline may be the points provided by the function.

The division aid point determining means selects, based on the outline data, a division aid point from the defining points. The division aid point cooperates with the division base point to define the division line.

The embroidery area dividing means divides the embroidery area into the two subareas by the division line.

The embroidery data producing means produces a set of embroidery data used for filling each of the subareas with stitches. Generally, a set of embroidery data consists of sets of stitch position data each of which is representative of a stitch position at which a needle pierces a workfabric to form a stitch. However, in the case where a subarea is further divided into blocks arranged along a central-line direction of the subarea (more specifically described, directions at respective positions on a single curve or polygonal line approximating the subarea), a set of embroidery data may consist of sets of block data each of which is representative of the outline of a corresponding one of the blocks. In this case, an additional means is required, which automatically produces, upon actual embroidering, sets of stitch position data based on each set of block data and the number of stitches per unit area, so that the sets of stitch position data are used for filling a corresponding block with stitches. Thus, the term "embroidery data" is used to indicate both stitch position data, and block data used for providing stitch position data. Furthermore, in the case where the embroidery data producing means comprises means for producing stitch position data, the stitch position data producing means may be of a type which produces stitch position data directly based on a subarea, or of a type which produces block data based on a subarea and subsequently produces stitch position data based on the block data.

Further search and study of the Applicant have proved that the above apparatus needs improvements. The division aid point determining means of the apparatus automatically determines a division aid point, irrespective of the shape of an outline of a subarea resulting from dividing an embroidery area by utilizing the division aid point. Therefore, in some cases, a division line provided by utilizing a division aid point inappropriately divides an embroidery area into two subareas such that the outline of one or both of the subareas has an inappropriate shape. For example, in the case of dividing an embroidery area shown in FIG. 9, inappropriate division lines, d-i and o-t, are determined, and inappropriate subareas are provided.

The division of the embroidery area of FIG. 9 is an example of division effected by an apparatus developed by the Applicant, which apparatus is disclosed in Japanese Patent Application No. 1-266548 (1989) and U.S. patent application Ser. No. 07/593,026 (1990). The apparatus includes (a) deflection point determining means for determining a reference direction with respect to an embroidery area and successively checking, based on outline data, defining points in an order of location thereof on an outline of the embroidery area, for a deflection point with respect to the reference direction, and (b) deflection direction determining means for determining, based on the outline data, whether or not the deflection point is an outward deflection point. The apparatus determines the outward deflection point as a division base point, and divides the embroidery area into subareas by a division line defined by the division base point and a division aid point determined by the division aid point determining means thereof.

The deflection point determining means of the above apparatus (i) applies a coordinate system to the embroidery area; (ii) judges whether or not two adjacent defining points preceding and following each of the defining points are both located in one or two half planes defined in the coordinate system on respective sides of a straight line which extends passing that each defining point in a direction perpendicular to the reference direction of the area and (iii) determines as a deflection point a defining point for which an affirmative judgement is provided.

In addition, the deflection direction determining means determines, in the case where the deflection point determining means successively checks the defining points on the outline in a clockwise direction, the deflection point as an outward deflection point if the adjacent defining point following the deflection point is located on a left-hand side of the deflection point as viewed in a direction of a vector starting at the adjacent defining point preceding the deflection point and ending at the deflection point and, on the other hand, in the case where the deflection point determining means successively checks the defining points in a counterclockwise direction, determines the deflection point as an outward deflection point if the adjacent defining point following the deflection point is located on a right-hand side of the deflection point as viewed in a direction of a vector starting at the adjacent defining point preceding the deflection point and ending at the deflection point.

The deflection point determining means of the above apparatus includes reference direction determining means for selecting the most distant two defining points from the defining points on the outline of the embroidery area, and determines as the reference direction a direction of a straight line, L (FIG. 9), passing the most distant two defining points. The division aid point determining means of the apparatus applies a coordinate system to the embroidery area, selects one or more of the defining points which is or are placed in one of two half planes provided in the coordinate system on respective sides of a straight line passing the division base point in a direction perpendicular to the line L which one half plane does not contain the two adjacent defining points preceding and following the division base point on the outline of the embroidery area, and determines as a division aid point one of the selected defining points which is the nearest to the division base point. When the apparatus is operated for dividing the embroidery area of FIG. 9, defining points, d and o, are selected as division base points from defining points through x defining the embroidery area, and defining points, i and t, are determined as division aid points corresponding to the division base points d and o, respectively.

Since the embroidery area of FIG. 9 includes branched portions, the embroidery area can be considered as a figure resulting from superposing a plurality of elongate figures each of which is approximated by a single straight line or curve. In such a case, it is required to divide the embroidery area into subareas, with consideration of the existence of the elongate figures behind the embroidery area. In other words, it is very important to determine a division line which divides the embroidery area into two subareas such that the outline of at least one of the subareas has a sufficient smoothness in the region of the division line.

However, as previously indicated, the embroidery area of FIG. 9 is divided by the above apparatus into inappropriate subareas by inappropriate division lines, d-i and o-t, indicated in broken lines in the figure. In other words, the embroidery area is divided without consideration of the existence of superposed elongate figures behind it, and the subareas resulting from dividing the embroidery area have no sufficient smoothness in the region of the division lines. If an embroidery area is inappropriately divided into subareas having inappropriate outlines, inappropriate embroidery data are produced based on the inappropriate subareas. Consequently, the stitches formed in one subarea in an embroidery direction thereof (indicated at arrow in FIG. 9) border upon the stitches formed in another subarea in a different embroidery direction, at an inappropriate location in the embroidery area, thereby lowering the quality of the embroidery produced.

The above indicated technique is of a type which divides an embroidery area so that the outline of each of the subareas resulting therefrom has no outward deflection point. The problem of inappropriately dividing a particular embroidery area, is found with another type of technique disclosed by the Applicant, for example in Japanese Patent Application No. 1-266549 and the previously indicated U.S. patent application Ser. No. 07/593,026 (1990). According to the another or second technique, an embroidery area is divided so that all straight segments obtained by connecting each of the most distant two defining points on the outline of each of the subareas resulting from dividing the embroidery area, and each of the other or remainder defining points on the outline, are contained inside the outline. In addition, the above problem is found with a third technique which divides an embroidery area by first applying the above indicated, first technique utilizing an outward deflection point, and subsequently applying the second technique.

SUMMARY OF THE INVENTION

It is therefore an object of the present invention to provide an embroidery data processing apparatus which determines a division line suitable for dividing an embroidery area into subareas.

The above object has been achieved by the present invention, which provides an apparatus for processing embroidery data used for filling an embroidery area with stitches, comprising first means for selecting a division base point from a plurality of defining points predetermined on an outline of the embroidery area, based on outline data representative of the outline of the embroidery area, and second means for selecting, based on the outline data, a division aid point from the defining points, so that the division aid point cooperates with the division base point to define a division line which divides the embroidery area into two subareas such that the outline of at least one of the two subareas satisfies a requirement predetermined with respect to smoothness at the division line.

In the embroidery data processing apparatus constructed as described above, a division aid point is determined so that a division line connecting between a division base point and the division aid point divides an embroidery area into two subareas such that the outline of at least one of the two subareas satisfies a requirement predetermined with respect to smoothness at the division line. In other words, the division line divides the embroidery area in such a manner that allows the embroidery area to be regarded as a figure resulting from superposing a plurality of simple elongate figures on each other. FIG. 10 shows the result of division of the embroidery area of FIG. 9 effected by an embodiment of the present apparatus. As is apparent from the subareas shown in FIG. 10, the present apparatus divides an embroidery area into subareas having appropriate outlines. Thus, the present apparatus produces embroidery data suitable for the embroidery area.

Generally, a division aid point determined by the second means of the present apparatus results in providing a division line which divides an embroidery area into two subareas such that the outline of only one of the two subareas satisfies the predetermined requirement with respect to smoothness in the region of the division line. However, in the case of dividing an embroidery area having a particular outline as shown in FIG. 11, the division aid point determined defines a division line which divides the embroidery area such that both of the two subareas resulting from the division of the embroidery area satisfy the predetermined requirement with respect to smoothness in the region of the division line. In this connection, the term "predetermined requirement" may indicate either an absolute or relative amount indicative of the smoothness.

In a preferred embodiment of the present invention, the apparatus further comprising means for dividing the embroidery area into the two subareas by the division line, and means for producing a set of embroidery data used for filling each of the subareas with stitches.

In another embodiment of the present invention, the first means includes reference direction determining means for determining a reference direction with respect to the embroidery area, and deflection point determining means for checking the defining points for a deflection point with respect to the reference direction, by judging whether or not two adjacent defining points preceding and following each of the defining points are located on one side of a straight line passing the each defining point in a direction perpendicular to the reference direction, the deflection point determining means determining as the deflection point a defining point for which an affirmative judgement is provided.

According to a feature of the present invention, the first means further includes deflection direction determining means for determining whether or not the deflection point is an outward deflection point, the deflection direction determining means determining, in the case where the deflection point determining means successively checks the defining points in an order of location thereof on the outline of the embroidery area in a clockwise direction, the deflection point as the outward deflection point if the adjacent defining point following the deflection point is located on a left-hand side of the deflection point as viewed in a direction of a vector starting at the adjacent defining point preceding the deflection point and ending at the deflection point, the first means determining the outward deflection point as the division base point.

According to another feature of the present invention, the first means further includes deflection direction determining means for determining whether or not the deflection point is an outward deflection point, the deflection direction determining means determining, in the case where the first checking means successively checks the defining points in an order of location thereof on the outline of the embroidery area in a counterclockwise direction, the deflection point as the outward deflection point if the adjacent defining point following the deflection point is located on a right-hand side of the deflection point as viewed in a direction of a vector starting at the adjacent defining point preceding the deflection point and ending at the deflection point, the first means determining the outward deflection point as the division base point.

According to yet another feature of the present invention, the reference direction determining means selects, based on the outline data, the most distant two defining points from the defining points, and determines as the reference direction a direction of a straight line passing the most distant two defining points.

In yet another embodiment of the present invention, the second means includes first candidate determining means for selecting, based on the outline data, the most distant two defining points from the defining points, determining a straight line passing the most distant two defining points as a longitudinal axis of the embroidery area, applying a coordinate plane to the embroidery area, and determining, as one or more first candidates for the division aid point, one or more of the defining points which is or are placed in one of two half planes provided in the coordinate plane on respective sides of a straight line passing the division base point in a direction perpendicular to the longitudinal axis which one half plane does not contain two adjacent defining points preceding and following the division base point on the outline of the embroidery area, second candidate determining means for judging whether or not three straight segments are connected to each other with a smoothness of more than a predetermined degree, the three segments consisting of a first segment connecting one of the two adjacent defining points preceding and following the division base point, and the division base point, a second segment connecting the division base point and each of the one or more first candidates, and a third segment connecting the each of the one or more first candidates, and one of two adjacent defining points preceding and following the each of the one or more first candidates, the second candidate determining means determining, if an affirmative judgement is provided, the each of the one or more first candidates as a second candidate for the division aid point, and means for determining, as the division aid point, one of the one or more second candidates which one second candidate is the nearest to the division base point.

Alternatively, it is possible to determine, as a division aid point, one of the above indicated first candidates which one first candidate results in providing a division line which divides the embroidery area into two subareas at least one of which has an outline with the highest smoothness in the region of the division line.

According to a feature of the present invention, the second means further includes third candidate determining means for determining the each of the one or more first candidates as a third candidate for the division aid point if a negative judgement is provided by the second candidate determining means, and means for determining, as the division aid point, one of the one or more third candidates which one third candidate is the nearest to the division base point if the one or more first candidates include no second candidate.

According to another feature of the present invention, the second candidate determining means provides an affirmative judgement if an angle contained between one segment of each of two pairs of adjacent segments out of the three segments, and a prolongation of the other segment of the each pair which prolongation extends from a defining point at which the one and other segments of the each pair are connected to each other, is smaller than a predetermined value. In this case, the predetermined value may be 30 degrees.

BRIEF DESCRIPTION OF THE DRAWINGS

The above and optional objects, features and advantages of the present invention will be better understood by reading the following detailed description of the presently preferred embodiment of the invention when considered in conjunction with the accompanying drawings, in which:

FIG. 3 is an illustrative view of a random access memory (RAM) of a microcomputer which constitutes an essential part of the control device of FIG. 2;

DETAILED DESCRIPTION OF THE PREFERRED EMBODIMENT

Figure 1:
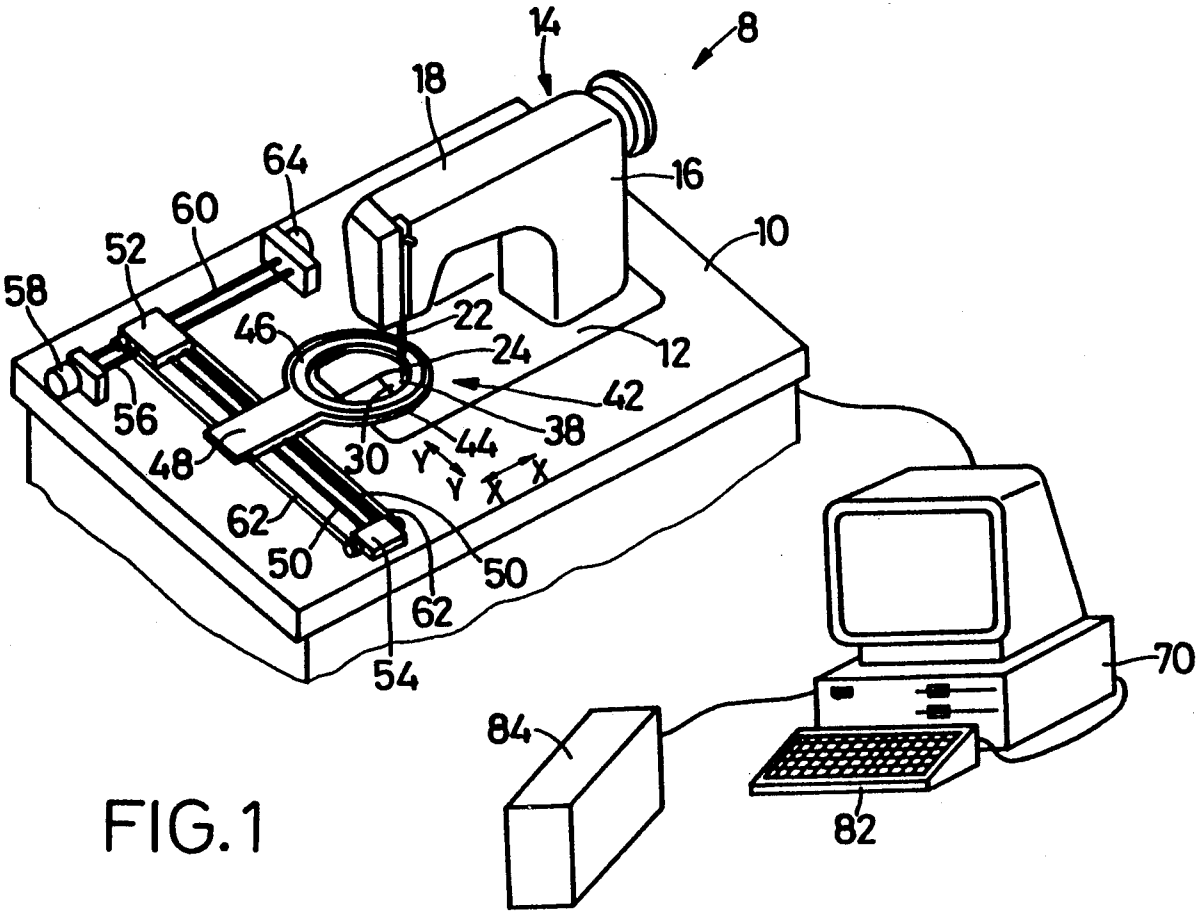
FIG. 1 is a perspective view of an embroidery sewing machine system including a data processing apparatus embodying the present invention.

Referring first to FIG. 1, there is shown an embroidery sewing machine system embodying the present invention. The system includes an embroidery sewing machine 8.

In FIG. 1, reference numeral 10 designates a table of the sewing machine 8 on which a bed 12 and a main frame 14 are provided. The main frame 14 includes a column 16 extending vertically upward from the bed 12, and an arm 18 extending horizontally from an upper portion of the column 16 like a cantilever. A needle bar 22 is connected to the main frame 14 via a needle bar frame (not shown), such that the needle bar 22 is vertically movable. A needle 24 is secured to a lower end of the needle bar 22. The needle bar 22 is coupled to a main motor 26 (FIG. 2) via a needle bar connecting bracket (not shown). The needle bar 22 and needle 24 are reciprocated vertically when the main motor 26 is driven. The bed 12 has an opening formed in an upper face thereof. A throat plate 30 having a needle aperture 38, closes the opening of the bed 12.

An embroidery frame 42 is mounted on the table 10 and bed 12, such that the embroidery frame 42 is movable along an X and a Y axis indicated at arrows X and Y, respectively. The X and Y axes are perpendicular to each other. The embroidery frame 42 includes an outer frame 44 having a ring portion, and an inner frame 46 fitting in the ring portion of the outer frame 44. The outer and inner frames 44, 46 cooperate with each other to support a workfabric (not shown) inserted therebetween. The outer frame 44 further includes a slide portion 48 extending from the ring portion thereof along the X axis away from the column 16. The slide portion 48 is slidably engaged with a pair of guide bars 50, 50 extending along the Y axis. Two pairs of corresponding opposite ends of the guide bars 50, 50 are connected by a first and a second connecting member 52, 54, respectively. The first connecting member 52 rests on a feed screw 56 and a rotation transmitting bar 60 each extending along the X axis, so that the first connecting member 52 is moved along the X axis when the feed screw 56 is driven or rotated by an X drive motor 58. In the meantime, the second connecting member 54 rests on the bed 10 via a ball member (not shown) rotatably supported by the second connecting member 54, so that the ball member is moved together with the second connecting member 54 as a unit. A pair of endless wires 62, 62 each engage the slide portion of the embroidery frame 42, and the first and second connecting members 52, 54. When the rotation transmitting bar 60 is rotated by a Y drive motor 64, the wires 62, 62 are displaced, so that the slide portion 48 is moved along the Y axis. By combination of the movement of the first connecting member 52 along the X axis and the movement of the slide portion 48 along the Y axis, the embroidery frame 42 is moved relative to the bed 10 to any position in a horizontal plane or an X-Y orthogonal coordinate system defined by the X and Y axes. The embroidery frame movement cooperates with the needle reciprocation movement to ensure that the sewing machine 8 embroiders an embroidery area on the workfabric by filling the area with stitches.

Figure 2:
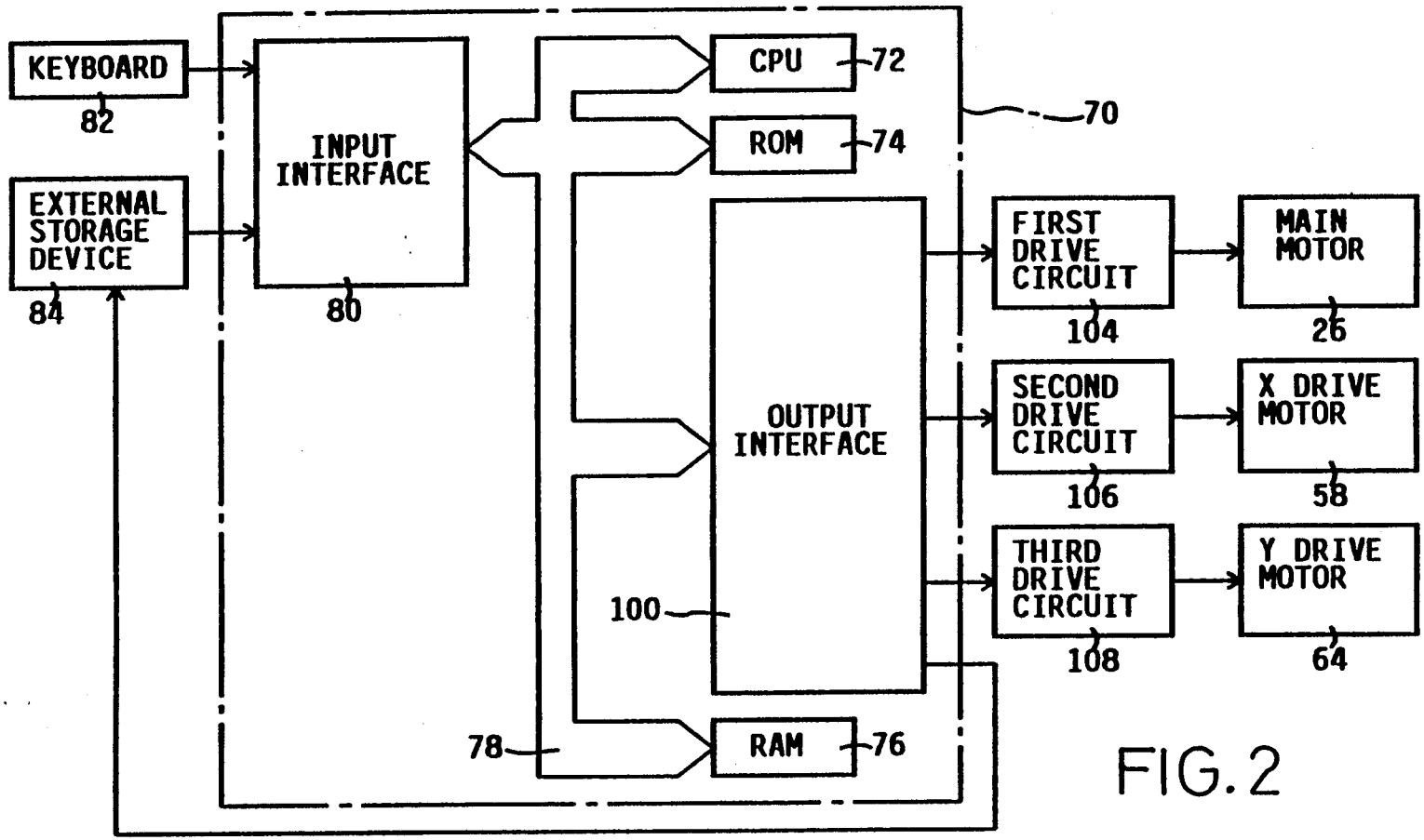
FIG. 2 is a diagrammatical view of a control device for controlling the operation of the system of FIG. 1.

The operation of the present sewing machine system is controlled by a control device 70. As illustrated in FIG. 2, the control device 70 consists essentially of a microcomputer which includes a central processing unit (CPU) 72, a read only memory (ROM) 74, a random access memory (RAM) 76, and a bus 78. The control device 70 further includes an input interface 80 to which a key board 82 and an external storage device 84 each are connected. The storage device 84 is capable of storing sets of outline data. Each outline data is representative of an outline of an embroidery area to be embroidered or filled with stitches. The outline data includes sets of position data each of which is representative of a corresponding one of defining points predetermined on the outline of the embroidery area. More specifically described, each position data is representative of X and Y coordinate values of a corresponding defining point in the X-Y coordinate system provided for the sewing machine 8. The defining points cooperate with each other to define a polygon, and serve as the vertices of the polygon. In other words, the outline of the embroidery area consists of the sides (straight segments) connecting the vertices of the polygon. The sets of position data for each set of outline data are stored in the storage device 84, with being associated with ordered addresses. The order of the addresses follows the order in which the defining points are located on the closed outline of the embroidery area. The sewing machine 8 embroiders an embroidery area by alternately connecting, using thread, between a pair of opposed portions of the outline of the embroidery area.

The control device 70 further includes an output interface 100 to which a first, a second, and a third drive circuit 104, 106, 108 are connected. The first, second, and third drive circuits 104, 106, 108 serve for driving the main motor 26, X drive motor 58, and Y drive motor 64, respectively.

As shown in FIG. 3, the RAM 76 includes a working area, and various data memory areas 76*a*, 76*b*, 76*i*, and 76*j*. The outline data area 76*a* stores sets of outline data, while the divided-outline data area 76*b* stores sets of divided-outline data. The block data area 76*i* stores sets of block data, while the stitch position data area 76*j* stores sets of stitch position data for each block data. The RAM 76 further includes various index data stacks 76*c*, 76*d*, 76*e*, 76*f*, 76*g*, and 76*h*. The before-division stack 76*c* stores sets of index data designating sets of outline data or divided-outline data before being subjected to the division routine (described later), and the after-division stack 76*d* stores sets of index data designating sets of outline data or divided-outline data after being subjected to the division routine. The vertex stack 76*e* stores sets of index data designating sets of position data each representative of the position of a vertex. The first candidate stack 76*f* stores sets of index data designating sets of position data each representative of the position of a vertex as a first candidate for a division aid point (described later), second candidate stack 76*g* stores sets of index data designating sets of position data each representative of the position of a vertex as a second candidate for the division aid point, and third candidate stack 76*h* stores sets of index data designating sets of position data each representative of the position of a vertex as a third candidate for the division aid point.

The function of each of the data memory areas and index data stacks 76a–76j of the RAM 76 will be described in detail later. In this connection, it is noted that the stacks 76c–76h are of a pushdown type.

Figure 4:
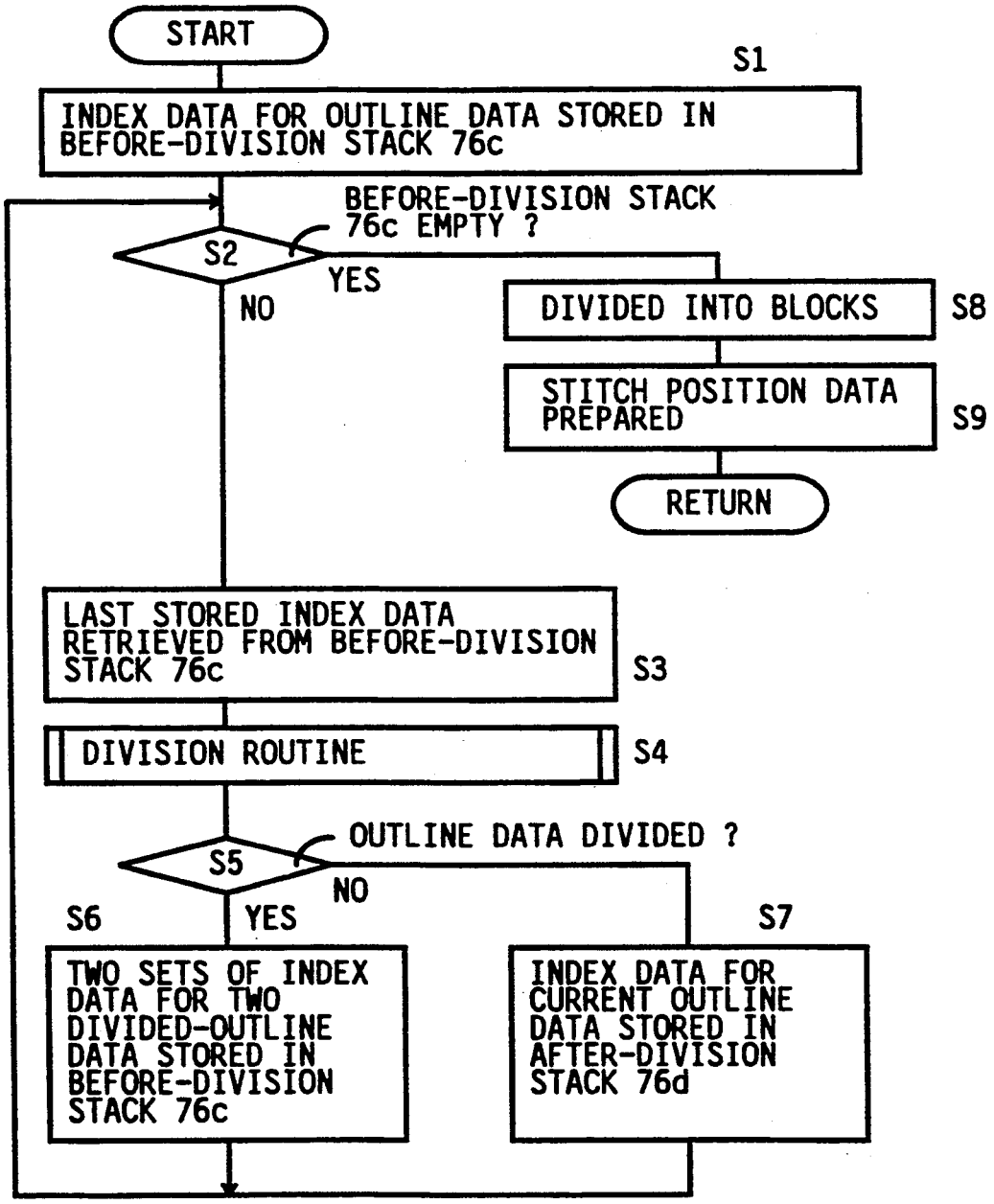
FIG. 4 shows a flow chart representing the stitch position data produce routine stored in a read only memory (ROM) of the microcomputer.

The ROM 74 stores the stitch position data producing program represented by the flow charts of FIGS. 4 and 5 (5A, 5B and 5C).

There will be described the operation of the present embroidery system effected for producing stitch position data used for embroidering an area on a workfabric, namely, filling the area with stitches.

Figure 6:
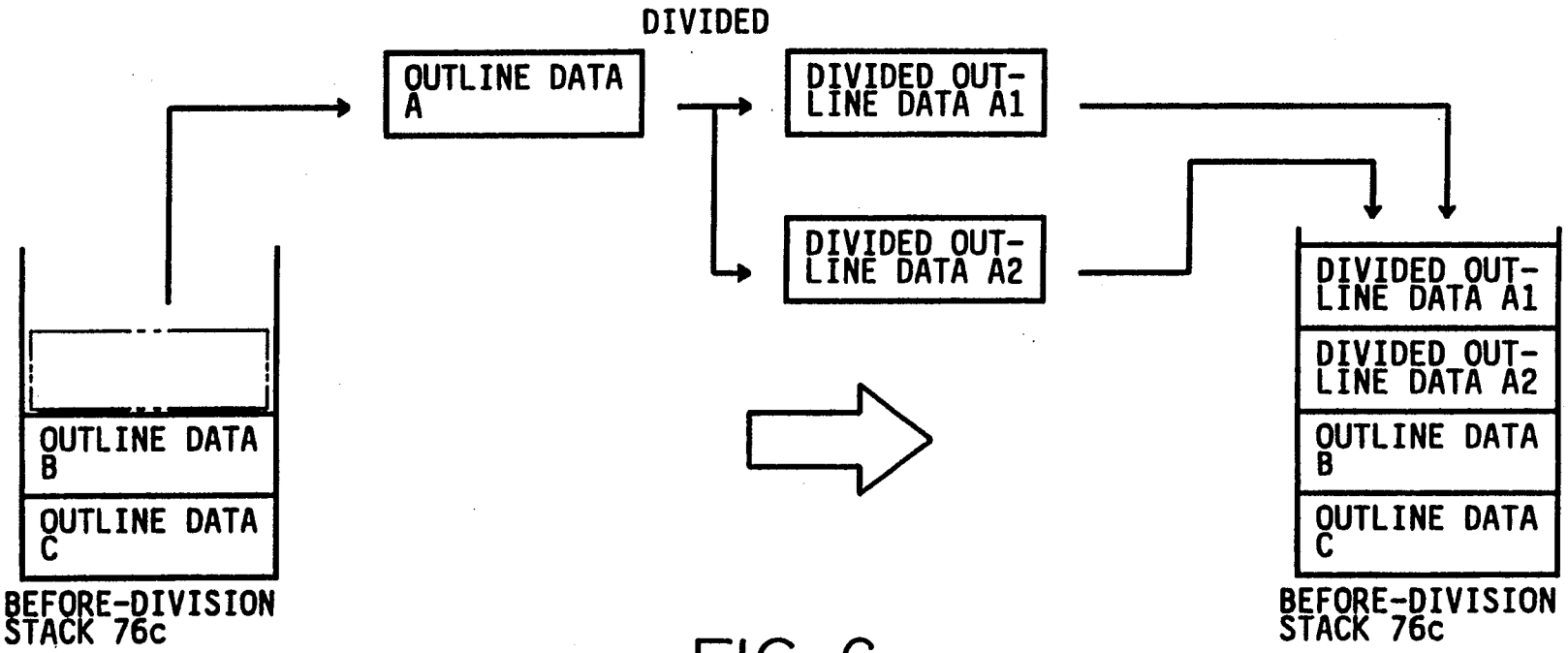
FIG. 6 is an illustrative view of a before-division stack of the RAM.

When the operator keys in a stitch position data produce command through the keyboard 82 after applying electric power to the present system, the control of the CPU 72 begins with Step S1 of FIG. 4 to read one or more sets of outline data from the external storage device 84, and store in the outline data area 76a of the RAM 76. In addition, one or more sets of index data each designating a corresponding one of the one ore more sets of outline data stored in the outline data area 76a, are stored in the before-division stack 76c, in the same order as the order of reading of the one or more sets of outline data from the external storage device 84. Step S1 is followed by Step S2 to judge whether or not the before-division stack 76c is empty, namely, the before-division stack 76c has no index data therein. Since the stitch position data producing operation has just started, a negative judgement is provided in Step S2 in the current cycle. Hence, the control proceeds with Step S3 to retrieve a set of index data from the before-division stack 76c which index data has been stored last in the stack 76c, and specify a set of outline data designated by the retrieved index data (hereinafter referred to as the current index data) as the current outline data. Similarly, the polygon defined by the vertices represented by the sets of position data included in the current outline data is referred to as the current polygon. For example, regarding an example shown in FIG. 6, sets of index data for sets of outline data (or polygons) A, B, and C are stored in the reverse order, namely, in the order of C, B and A in the before-division stack 76c, and the last stored index data for outline data A is retrieved for the first.

Step S3 is followed by Step S4, namely, the division routine. If the current polygon includes an outward deflection vertex, the polygon is divided into two sub-polygons by being subjected to the division routine. By repetitively being subjected to the division routine, a polygon is divided so that each of the sub-polygons resulting from dividing the polygon has no outward deflection vertex.

Figure 5A:
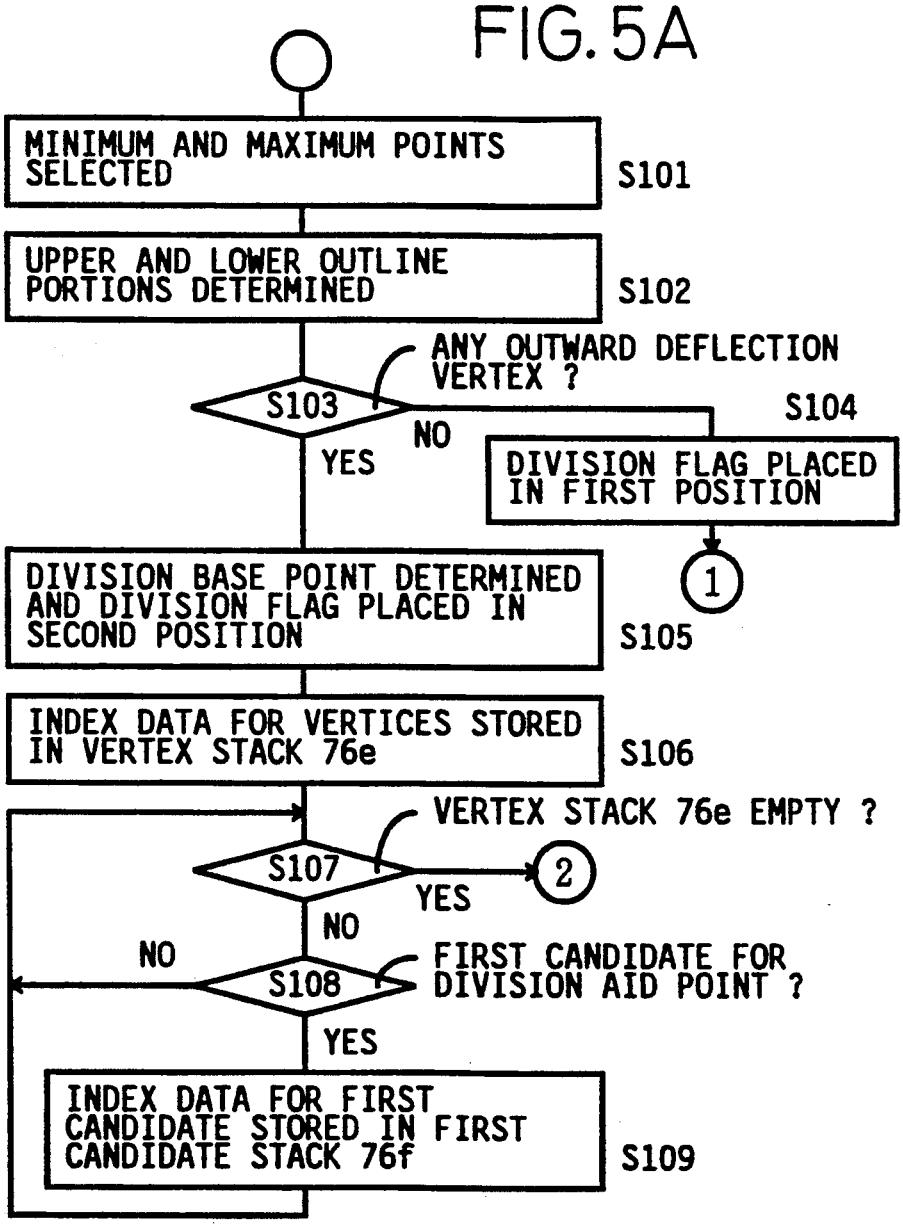
FIGS. 5A, 5B and 5C show a flow chart representing the division routine as a sub-routine of the routine of FIG. 4.
Figure 5B:
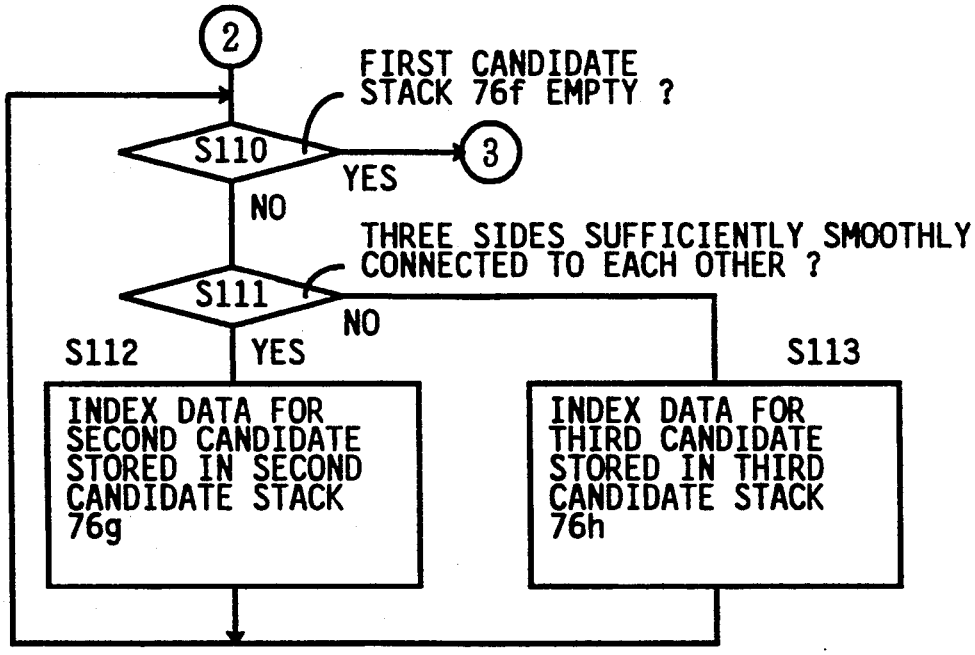
Figure 5C:
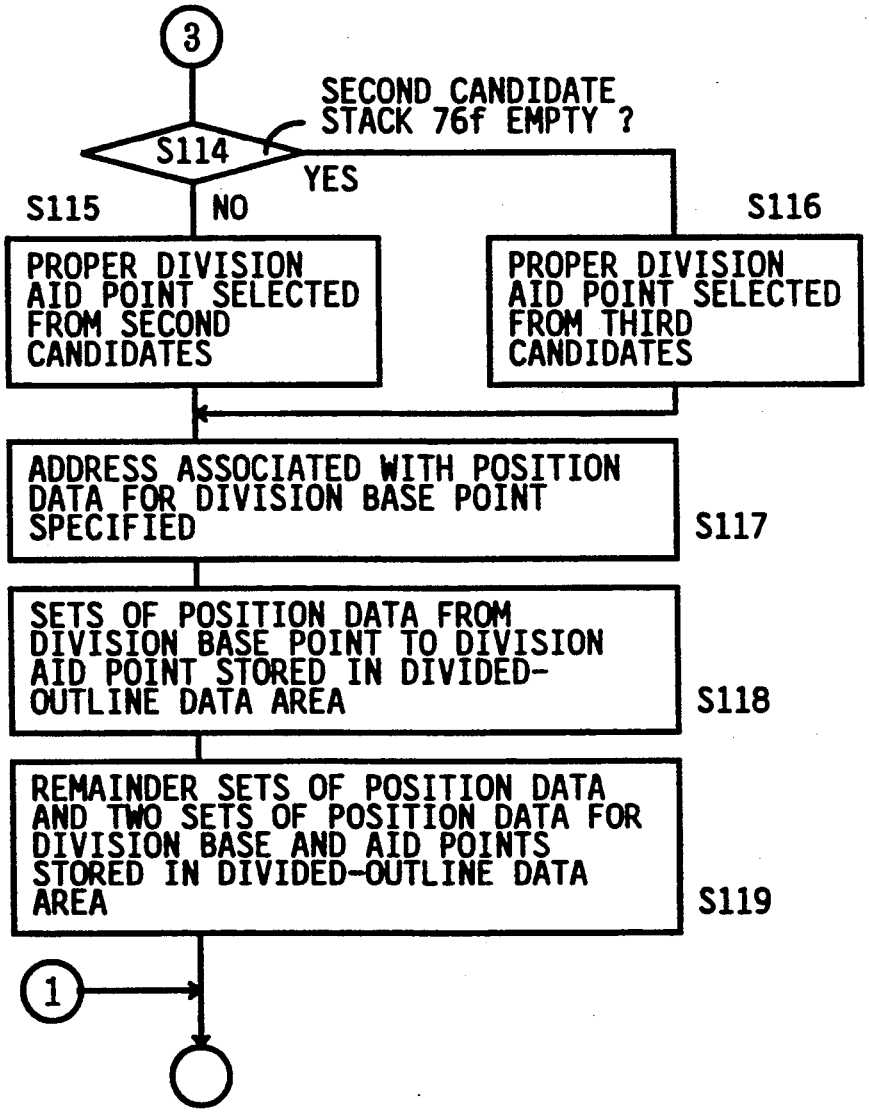

The division routine is illustrated in detail in the flow chart of FIGS. 5A, 5B and 5C. The control begins with Step S101 to read the current outline data from the outline data area 76a or divided-outline data area 76b. In the case where the current outline data has not been subjected to the division routine, the current outline data is read from the outline data area 76a. On the other hand, in the case where the current outline data has been subjected to the division routine, the current outline data is read from the divided-outline data area 76b. In addition, in Step S101, the most distant two vertices are selected from all the vertices of the current polygon, based on the current outline data. One of the most distant vertices which has the smaller X coordinate value, is determined as a minimum point of the current polygon, while the other of the most distant vertices that has the greater X coordinate value, is determined as a maximum point. For example, regarding an embroidery area or polygon Q shown in FIG. 7, vertices a and are selected as the most distant two vertices of all vertices a through x of polygon Q. Since the X coordinate value of vertex is smaller than that of vertex m, vertex a is determined as the minimum point and vertex m is determined as the maximum point.

Step S101 is followed by Step S102 to define the direction of a straight line passing the minimum and maximum points, as a longitudinal direction of the current polygon. The straight line is referred to as the longitudinal axis of the polygon. The outline of the current polygon consists of upper and lower portions which are opposed to each other with respect to the longitudinal axis. For example, regarding polygon Q of FIG. 7, the sides connecting vertices a, b, c, d, e, f, g, h, i, j, k, ( and m in order, provide the upper portion of the outline, while sides connecting vertices m, n, o, p, q, r, s, t, u, v, w, x and a in order, provide the lower portion of the outline.

Step S102 is followed by Step S103 to check all the vertices of the current polygon for an outward deflection vertex with respect to the longitudinal direction of the polygon. The technique for checking the vertices of a polygon for an outward deflection vertex is disclosed in the previously identified Japanese Patent Application No. 1-266548 (1989) and U.S. patent application Ser. No. 07/593,026 (1990). Further description of the technique is omitted. For example, regarding polygon Q of FIG. 7, vertices d and o each are determined as an outward deflection vertex. In addition, in the present embodiment, if the number of the vertices belonging to the upper portion of the outline is not less than that of the vertices belonging to the lower portion, the vertices of the upper portion are checked for an outward deflection vertex earlier than those of the lower portion. Therefore, regarding polygon Q, vertex d is determined as an outward deflection vertex earlier than vertex o.

In the case where neither the upper nor lower portion of the outline of the current polygon has an outward deflection vertex, a negative judgement is provided in Step S103. In this case, the control proceeds with Step S104 to place a division flag in a first position indicating that the current polygon does not need a division. Subsequently, the control goes to Step S5 of FIG. 4. On the other hand, in the case where the outline of the current polygon has an outward deflection vertex, an affirmative judgement is provided in Step S103. In this case, the control proceeds with Step S105 to determine the outward deflection vertex as a division base point, and place the division flag in a second position indicating that the current polygon needs a division. Step S105 is followed by Step S106 to store in the vertex stack 76e sets of index data for all the sets of position data corresponding to the vertices defining the current polygon.

Step S106 is followed by Step S107 to identify whether or not the vertex stack 76e is empty. In the present situation, a negative judgement is provided in Step S107, and the control goes to Step S108 to retrieve the last stored index data from the vertices stack 76e, and use as the current vertex the vertex represented by the position data designated by the retrieved index data. Further, in Step S108, is judged whether or not the current vertex is a first candidate for a division aid point which cooperates with the division base point to define a straight segment (hereinafter, referred to as the division line) which divides the current polygon into two sub-polygons. The division line serves as a side common to the two sub-polygons. More specifically described, is judged whether or not the current vertex is located in one of two half areas provided in the X-Y coordinate system on respective sides of a straight line passing the division base point in a direction perpendicular to the longitudinal direction of the current polygon, which one half area does not contain the two vertices adjacent to the division base point on respective sides of the division base point on the outline of the current polygon. If an affirmative judgement is made, the current vertex is judged as a first candidate for the division aid point to be associated with the division base point determined in Step S105. In the case where an affirmative judgement is provided in Step S108, the control goes to Step S109 to store the index data designating the current vertex, in the first candidate stack 76*f*. On the other hand, in the case where a negative judgement is provided in Step S108, the control goes back to Step S107 to check the following vertex for a first candidate. For example, regarding the division base point, d, of polygon Q of FIG. 7, vertices g through u each are determined as a first candidate for the division aid point to be associated with the division base point d.

If an affirmative judgement is provided in Step S107 while Steps S107, S108 and S109 repetitively are effected, the control goes to Step S110 to identify whether or not the first candidate stack 76*f* is empty. If a negative judgement is provided in Step S110, the control goes to Step S111 to retrieve the last stored index data from the first candidate stack 76*f*, and uses as the current vertex the vertex represented by the position data designated by the retrieved index data. Further, in Step S111, it is judged whether or not three sides are sufficiently smoothly connected to each other. The three sides consist of (1) either one of two sides connected to each other at the division base point determined in Step S105, (2) either one of two sides connected to each other at the current vertex, and (3) a straight segment or side connecting between the division base point and the current vertex. More specifically described, it is judged whether or not, regarding each of two pairs of adjacent sides out of the three sides, an angle contained between one of the two sides of the each pair and a prolongation of the other side which prolongation extends from the vertex or point at which the one and other sides of the each pair are connected to each other, is smaller than 30 degrees. That is, it is judged whether or not, regarding each of two pairs of adjacent sides out of the three sides, a smaller one of two angles defined between one of the two sides of the each pair and the other side of the each pair, is greater than 150 degrees. If an affirmative judgement is provided in Step S111, namely, if the three sides are sufficiently smoothly connected to each other, the control goes to Step S112 to store the index data for the current vertex in the second candidate stack 76*g*. On the other hand, if a negative judgement is provided in Step S111, namely, if the three sides are not sufficiently smoothly connected to each other, the control goes to Step S113 to store the index data for the current vertex in the third candidate stack 76*h*.

Figure 7:
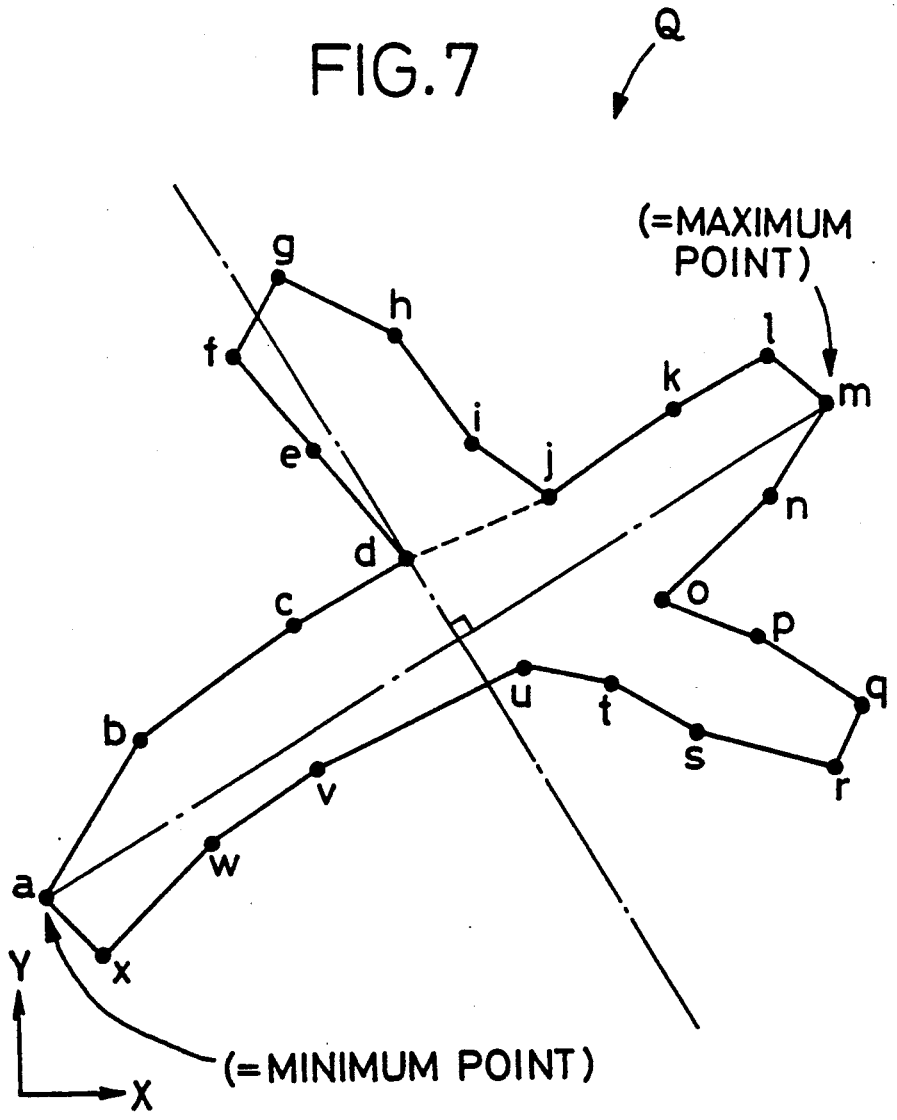
FIG. 7 is a view for explaining the manner of determining a division line for an embroidery area in the embodiment of FIG. 1.

For example, regarding polygon Q of FIG. 7, vertices c, d, j and k define three sides sufficiently smoothly connected to each other. Similarly, vertices c, d, k and l, vertices c, d, o and p, vertices c, d, p and q, vertices e, d, o and p, vertices e, d, p and q, and vertices e, d, s and r, vertices e, d, t and s, or vertices e, d, u and t define sufficiently smoothly connected three sides. Therefore, vertices j, k, o, p, s, t and u each are selected as a second candidate, and the sets of index data for the selected vertices are stored in the second candidate stack 76*g*. In addition, the sets of index data for vertices g, h, i, l, m, n, q and r each of which is a first candidate but not a second candidate, are stored in the third candidate stack 76*h*.

If an affirmative judgement is provided in Step S110 while Steps 110, 111, 112 and 113 repetitively are effected, the control goes to Step S114 to identify whether or not the second candidate stack 76*g* is empty. In the case where a negative judgement is provided in Step S104, the control goes to Step S105 to select as a proper division aid point one of the second candidates which is the nearest to the division base point. For example, regarding polygon Q of FIG. 7, vertex j which is the nearest to the division base point d is selected as the division aid point for the division base point d. On the other hand, in the case where the second candidate stack 76*g* is empty and therefore an affirmative judgement is provided in Step S114, the control goes to Step S116 to select as a proper division aid point one of the third candidates which is the nearest to the division base point.

In either case, subsequently, the control goes to Step S117 to specify, in the current outline data, the address associated with the position data for the division base point. Step S117 is followed by Step S118 to specify, in the current outline data, the sets of position data between the position data for the division base point and the position data for the division aid point, inclusive, and store, in the divided-outline data area 76*b*, the specified sets of position data as a set of divided-outline data with being associated with a set of index data therefor. The divided-outline data is representative of the outline of a sub-polygon resulting from the current polygon. Step S118 is followed by Step S119 to specify the position data for the division base point, position data for the division aid point, and sets of position data for the vertices other than the vertices belonging to the sub-polygon obtained in Step S118. The thus specified sets of position data are stored in the divided-outline data area 76*b* as a set of divided-outline data with being associated with a set of index data therefor. The divided-outline data is representative of the outline of another sub-polygon resulting from the current polygon. This means a division of the current polygon.

Figure 8:
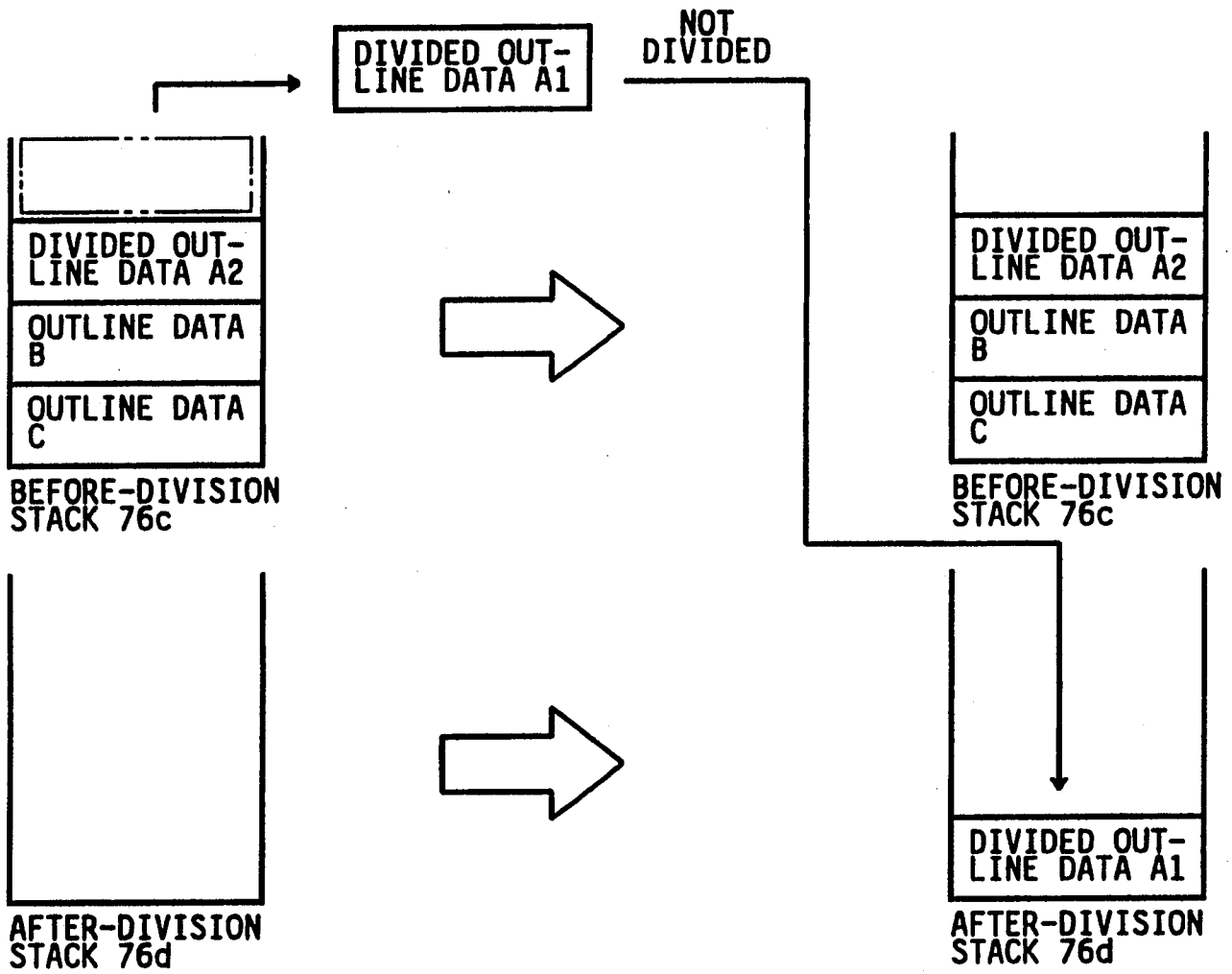
FIG. 8 is an illustrative view of an after-division stack of the RAM.
Figure 9:
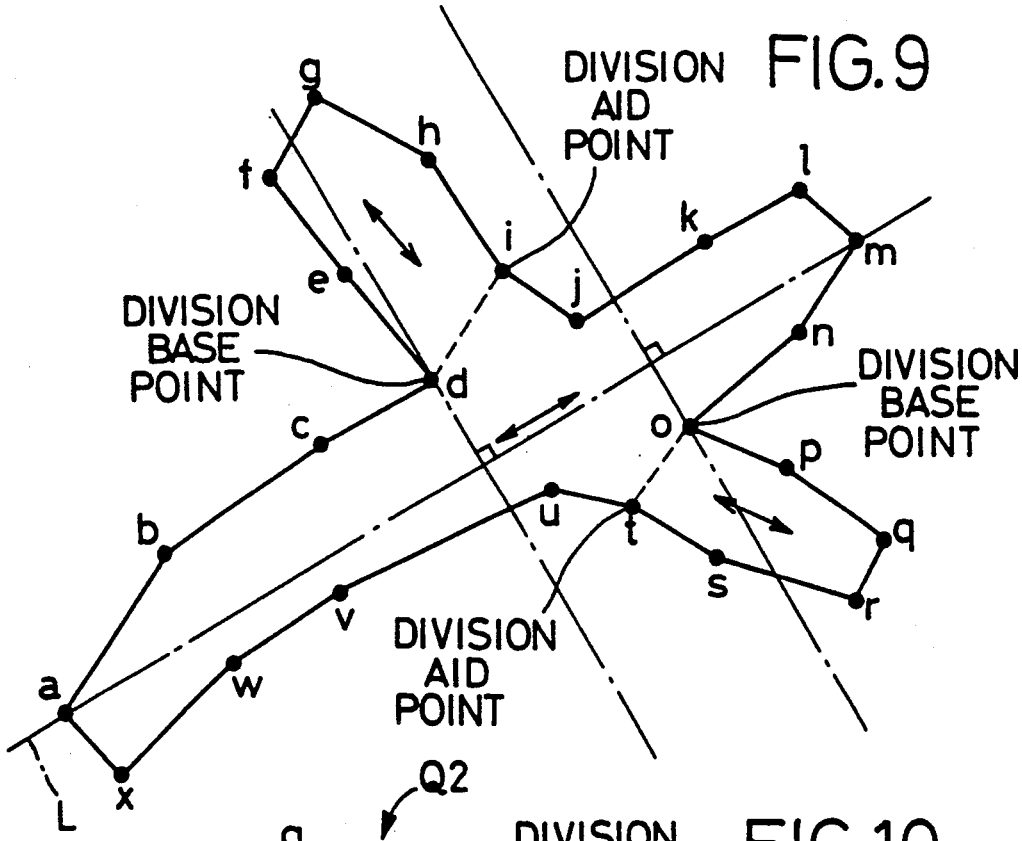
FIG. 9 is a view illustrating the division lines determined for the embroidery area of FIG. 7 by an embroidery data processing apparatus proposed by the Applicant prior to the present invention.
Figure 10:
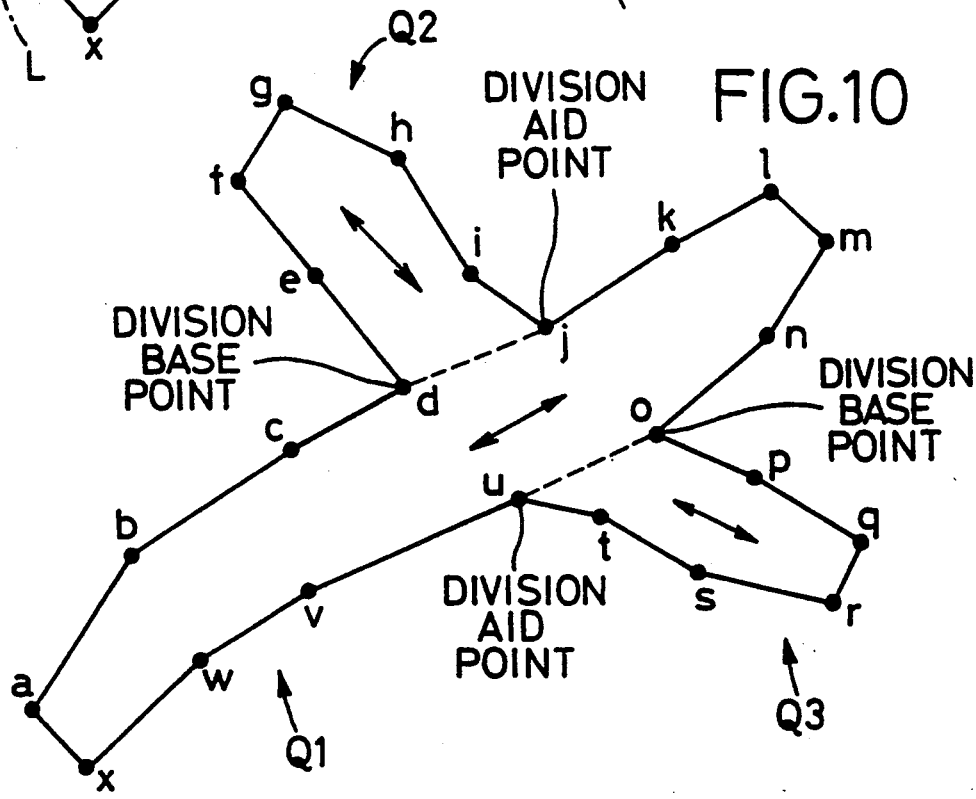
FIG. 10 is a view illustrating the division lines determined for the embroidery area of FIG. 7 by the embodiment of FIG. 1.
Figure 11:
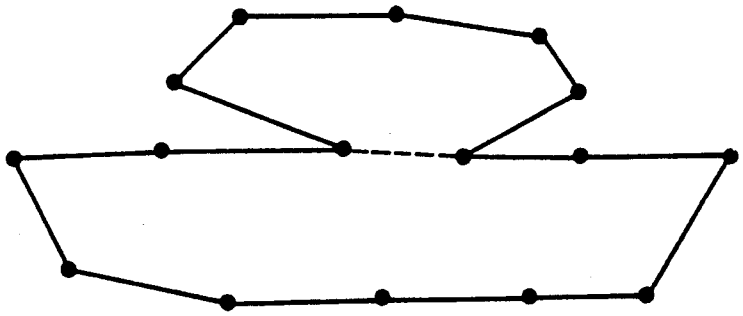
FIG. 11 is a view illustrating the division of another embroidery area effected according to the present invention.

Subsequently, the control goes to Step S5 of FIG. 4 to identify whether or not the current polygon has been divided. In the case where the division flag has been placed in the second position in Step S105 of FIG. 5A, an affirmative judgement is provided in Step S5. On the other hand, in the case where the division flag has been placed in the first position in Step S104, a negative judgement is provided in Step S5. If an affirmative judgement is provided in Step S5, the control goes to Step S6 to store in the before-division stack 76*c* the two sets of index data for the two sub-polygons obtained in Steps S118 and S119 of FIG. 5C. On the other hand, if a negative judgement is provided in Step S5, the control goes to Step S7 to store the index data for the current outline data or polygon, in the after-division stack 76*d*. For example, regarding outline data, A, of FIG. 6, if outline data A has been divided into two sets of divided-outline data, A1 and A2, two sets of index data for the two sets of divided-outline data are stored in the before-division stack 76*c*. As illustrated in FIG. 8, the last stored index data corresponding to divided-outline data A1 is retrieved in Step S3 in the next cycle, so that divided-outline data A1 is subjected to the division routine of Step S4. If divided-outline data A1 is not divided in Step S4, the index data for divided-outline data A1 is stored in the after-division stack 76*d*.

If an affirmative judgement is provided in Step S2 while Steps S2 through S7 are repeated, the control goes to Step S8 to divide each of the polygons or sub-polygons represented by the sets of outline or divided-outline data designated by the sets of index data stored in the after-division stack 76*d*, into triangular or quadrangular blocks arranged generally along the longitudinal direction of the each polygon or sub-polygon. In addition, in Step S8, sets of block data each representative of the outline of a corresponding block, are stored in the block data area 76*i*. Each block data consists of sets of position data for the vertices belonging to the corresponding block. The technique for dividing a polygon or sub-polygon into blocks arranged along the longitudinal direction of the polygon or sub-polygon are disclosed in the previously identified Japanese Patent Application No. 1-266548 (1989) and U.S. patent application Ser. No. 07/593,026 (1990). Therefore, further description of the technique is omitted.

Step S8 is followed by Step S9 to produce a set of stitch position data used for filling each of the triangular or quadrangular blocks with stitches, based on the set of block data representative of the outline of the each block. Specifically, a plurality of stitch positions are determined on two sides out of the three or four sides defining the each block which two sides are opposed to each other generally in a direction perpendicular to the longitudinal direction of the polygon or sub-polygon to which the each block belongs. A set of stitch position data consists of sets of position data each representative of a corresponding stitch position. The thus produced stitch position data is stored in the stitch position data area 76*j*.

Thus, one cycle of the flow charts of FIGS. 4 and 5 is ended. For example, if polygon Q of FIG. 7 is subjected to this division, polygon Q is divided into sub-polygons $Q_1$, $Q_2$, $Q_3$ each of which has an outline with an appropriate shape, by using division lines, d-j and o-u, which are suitable for the shape of outline of polygon Q.

Thereafter, when the operator keys in an embroidery start command through the keyboard 82 to embroider a desired area on a workfabric by filling the area with stitches, the stitch position data prepared for the desired area is used for controlling the sewing machine 8 and thereby producing the embroidery of the desired area.

As emerges from the foregoing, in the present embodiment, a portion of the microcomputer of FIG. 2 which portion serves for effecting Steps S101 through S103 and S105 provides means for selecting a division base point from the defining points predetermined on an outline of an embroidery area, based on outline data representative of the outline of the embroidery area. In addition, a portion of the microcomputer of FIG. 2 which portion serves for effecting Steps S106 through S116 provides means for selecting, based on the outline data, a division aid point from the defining points.

While the present invention has been described with the detailed description of the presently preferred embodiment, it is to be understood that the present invention may be embodied with various changes, modifications and improvements that may occur to those skilled in the art without departing from the spirit and scope of the invention defined in the appended claims.

What is claimed is:

1. An apparatus for processing embroidery data and utilizing the embroidery data for filling an embroidery area with stitches, comprising:

first means for selecting a division base point from a plurality of defining points predetermined on an outline of said embroidery area, based on outline data representative of said outline of the embroidery area;

second means for selecting, based on said outline data, a division aid point from said defining points, so that said division aid point cooperates with said division base point to define a division line which divides said embroidery area into two subareas such that the outline of at least one of said two subareas satisfies a requirement predetermined with respect to smoothness at said division line;

data producing means for dividing said embroidery area into said two subareas by said division line, and producing said embroidery data for filling each of said subareas with stitches; and data utilization means for utilizing said embroidery data to form said stitches.

2. The apparatus as set forth in claim 1, wherein said first means includes:

reference direction determining means for determining a reference direction with respect to said embroidery area; and deflection point determining means for checking said defining points for a deflection point with respect to said reference direction, by judging whether or not two adjacent defining points preceding and following each of said defining points are located on one side of a straight line passing said each defining point in a direction perpendicular to said reference direction, said deflection point determining means determining as said deflection point a defining point for which an affirmative judgement is provided.

3. The apparatus as set forth in claim 2, wherein said first means further includes deflection direction determining means for determining whether or not said deflection point is an outward deflection point, said deflection direction determining means determining, in the case where said deflection point determining means successively checks said defining points in an order of location thereof on the outline of said embroidery area in a clockwise direction, said deflection point as said outward deflection point if the adjacent defining point following said deflection point is located on a left-hand side of said deflection point as viewed in a direction of a vector starting at the adjacent defining point preceding said deflection point and ending at said deflection point, said first means determining said outward deflection point as said division base point.

4. The apparatus as set forth in claim 2, wherein said first means further includes deflection direction determining means for determining whether or not said deflection point is an outward deflection point, said deflection direction determining means determining, in the case where said first checking means successively checks said defining points in an order of location thereof on the outline of said embroidery area in a counterclockwise direction, said deflection point as said outward deflection point if the adjacent defining point following said deflection point is located on a right-hand side of said deflection point as viewed in a direction of a vector starting at the adjacent defining point preceding said deflection point and ending at said deflection point, said first means determining said outward deflection point as said division base point.

5. The apparatus as set forth in claim 2, wherein said reference direction determining means selects, based on said outline data, the most distant two defining points from said defining points, and determines as said reference direction a direction of a straight line passing said most distant two defining points.

6. The apparatus as set forth in claim 1, wherein said second means includes:

first candidate determining means for selecting, based on said outline data, the most distant two defining points from said defining points, determining a straight line passing said most distant two defining points as a longitudinal axis of said embroidery area, applying a coordinate plane to said embroidery area, and determining, as one or more first candidates for said division aid point, one or more of said defining points which is or are placed in one of two half planes provided in said coordinate plane on respective sides of a straight line passing said division base point in a direction perpendicular to said longitudinal axis which one half plane does not contain two adjacent defining points preceding and following said division base point on the outline of said embroidery area;

second candidate determining means for judging whether or not three straight segments are connected to each other with a smoothness of more than a predetermined degree, said three segments consisting of a first segment connecting one of the two adjacent defining points preceding and following said division base point, and said division base point, a second segment connecting said division base point and each of said one or more first candidates, and a third segment connecting said each of said one or more first candidates, and one of two adjacent defining points preceding and following said each of said one or more first candidates, said second candidate determining means determining, if an affirmative judgement is provided, said each of said one or more first candidates as a second candidate for said division aid point; and means for determining, as said division aid point, one of the one or more second candidates which one second candidate is the nearest to said division base point.

7. The apparatus as set forth in claim 6, wherein said second means further includes:

third candidate determining means for determining said each of said one or more first candidates as a third candidate for said division aid point if a negative judgement is provided by said second candidate determining means; and means for determining, as said division aid point, one of the one or more third candidates which one third candidate is the nearest to said division base point if said one or more first candidates include no second candidate.

8. The apparatus as set forth in claim 6, wherein said second candidate determining means provides an affirmative judgement if an angle contained between one segment of each of two pairs of adjacent segments out of said three segments, and a prolongation of the other segment of said each pair which prolongation extends from a defining point at which the one and other segments of said each pair are connected to each other, is smaller than a predetermined value.

9. The apparatus as set forth in claim 8, wherein said predetermined value is 30 degrees.

* * * * *